US006203390B1

(12) United States Patent
Elliott

(10) Patent No.: US 6,203,390 B1
(45) Date of Patent: Mar. 20, 2001

(54) LIFE JACKET HAVING DEPLOYABLE BALLOON

(75) Inventor: Russell R. Elliott, Palm Harbor, FL (US)

(73) Assignee: Steven L. Rogers, Sarasota, FL (US)

( * ) Notice: Subject to any disclaimer, the term of this patent is extended or adjusted under 35 U.S.C. 154(b) by 0 days.

(21) Appl. No.: 09/205,957

(22) Filed: Dec. 4, 1998

(51) Int. Cl.[7] ..... B63C 9/00
(52) U.S. Cl. ..... 441/80; 441/88; 441/89
(58) Field of Search ..... 224/148.1–148.7; 2/247–250; 441/80, 88–119; 114/39.18

(56) References Cited

U.S. PATENT DOCUMENTS

| | | | | |
|---|---|---|---|---|
| 4,047,255 | * | 9/1977 | Kiefer | 114/39.18 |
| 4,740,183 | * | 4/1988 | McKenzie | 441/104 |
| 5,305,471 | * | 4/1994 | Steele et al. | 2/102 |
| 5,465,425 | * | 11/1995 | Crispin | 2/102 |
| 5,722,573 | * | 3/1998 | Carnel | 224/148.2 |

* cited by examiner

*Primary Examiner*—Ed Swinehart

(74) *Attorney, Agent, or Firm*—Ronald E. Smith; Smith & Hopen, P.A.

(57) ABSTRACT

An elongate, flexible tether line connects to a life jacket a large, brightly-colored balloon that is easy for a rescuer to observe when it is inflated and floating in a body of water. The balloon is stored within an internal cavity of the life jacket in a deflated condition and is inflated upon removal from the cavity. A first end of the tether line is secured to a liner that forms a pocket in the internal cavity so that when the balloon is fully deployed, the liner is turned inside-out to prevent water from the external environment from entering into the internal cavity. A funnel is formed in the balloon and is in fluid communication with a downspout that is in fluid communication with a reservoir formed in the balloon. The funnel collects rainwater and the reservoir stores the rainwater. A drinking spout enables a user to consume the stored water as needed. The life jacket also contains an internal cavity for storage of a small mirror for signaling rescuers and pre-filled water containers for use if there is insufficient rainfall and at least one of the water containers may have a mirrored surface to provide a signaling device. A first pocket for holding the balloon in a deflated condition and a second pocket for holding the pre-filled water containers may also be retrofitted to an external surface of the life jacket for use with a life jacket lacking internal cavities.

15 Claims, 6 Drawing Sheets

LIFE JACKET HAVING DEPLOYABLE BALLOON

BACKGROUND OF THE INVENTION

1. Field of the Invention

This invention relates, generally, to rescue devices. More particularly, it relates to a life jacket having an internal pocket for storage of a large, easy-to-see balloon that is manually deployable to make it easy for rescuers to spot a person in a large body of water.

2. Description of the Prior Art

A person wearing a life jacket while floating in a large body of water is very difficult to see from a helicopter or airplane. The human head is not much larger than a coconut and looking for a person floating in the ocean has been compared to looking for a coconut bobbing in the water while flying past it at seventy miles per hour.

A number of devices have been developed to make a person in water more visible to rescuers. For example, U.S. Pat. No. 5,245,943 to Hull et al. provides a large inflatable raft-like device that has the letters SOS written on it. Since the raft-like device is much larger than a human head, it is relatively easy to spot. The device cannot be stored within a life jacket, however; a person donning a life jacket in an emergency situation must remember to take the raft-like device with them.

There are also a few patents that disclose devices having utility in connection with persons who are lost on land. For example, U.S. Pat. No. 3,951,260 to Frazee discloses a helium-filled balloon that is tethered to a backpack; a lost hiker can deploy the balloon to aid searchers. However, the balloon is stored in a backpack as aforementioned, and there is no suggestion as to how such a balloon could be stored in a life jacket.

There remains a need for a large, easily visible balloon that is stored in a life jacket in a deflated condition and which can be manually deployed and manually inflated when needed. The deflated balloon should be an integral part of the life jacket so that there is no need to remember to take the balloon when entering the water.

Moreover, the balloon should be stored within the life jacket in such a way that it does not cause the external surface of the life jacket to bulge out. This would ensure that a life jacket equipped with the novel balloon would not take up any more storage space than a conventional life jacket.

A person lost at sea for a day or more will need a supply of fresh water in order to survive. Thus, there is also a need for a means of providing fresh water to a person floating in seawater.

Moreover, a signaling means is needed as well to improve the chances of rescue.

However, it was not obvious to those of ordinary skill in this art how the identified needs could be met, in view of the art considered as a whole at the time the present invention was made.

SUMMARY OF THE INVENTION

The long-standing but heretofore unfulfilled need for an innovation that overcomes the limitations of the prior art is now met by a new, useful, and nonobvious invention. The present invention includes a life jacket having a back part, a left part and a right part. The back, left and right parts are integrally formed with one another and the left and right parts have inboard edges that are disposed in confronting relation to one another when the life jacket is worn by a user.

A first cavity is formed within the life jacket and a first access opening is formed in a first preselected part of the life jacket to provide access to the first cavity. A pocket means is positioned within the first cavity. More particularly, the pocket means is formed by a bag-like liner; the liner has a mouth that circumscribes and is secured to the first access opening.

A deflated balloon is disposed within the pocket, and a mounting means is secured to a lowermost part of the liner. An elongate, flexible tether line has a first end secured to the mounting means and a second end secured to the deflated balloon. The balloon is adapted to be inflated when the balloon is disposed external to the pocket. Removing the balloon and the tether line from the pocket reverses the liner by pulling the liner inside-out and thereby prevents entry of water into the first cavity.

A first pocket flap is secured to the preselected part of the life jacket in covering relation to the first access opening to prevent water from entering into the pocket when the balloon and the tether line are disposed within the pocket.

An inflation means is provided for inflating the balloon when it is positioned externally to the pocket; the inflation means may be manual or automatic.

A funnel is formed in the balloon at a first predetermined location, and a downspout is formed integrally with a lowermost end of the funnel. A reservoir is integrally formed with a lowermost end of the downspout so that rainwater caught by the funnel is retained within the reservoir. A drinking spout is secured to the balloon at a preselected point along a perimeter of the funnel so that tilting the balloon enables rainwater in the reservoir to flow from the reservoir, through the downspout, over the funnel and into the drinking spout.

In a further embodiment, a second cavity is formed within the life jacket and a second access opening is formed in a second preselected part of the life jacket. A water container is positioned within the second cavity so that a user of said life jacket may consume water in said container. A second pocket flap is secured to the second preselected part of the life jacket to prevent water from an environment external to the life jacket from entering into the second access opening.

The water container may take the form of a plurality of water bladders that are releasably connected to one another to enable them to be separated from one another and consumed independently of one another. Means are provided for opening each of the water bladders to facilitate consumption of water therefrom.

A mirror may be added to the life jacket as a separate item, or one or more of the water containers may be provided with one or more mirrored surfaces so that a person awaiting rescue can direct sunlight toward a rescue vehicle by means of the mirror or mirrored surface.

It is a primary object of this invention to provide a life jacket that contains within it a deflated balloon that is deployable from the life jacket and inflatable to serve as an easy-to-see marker to maximize a person's chances of rescue when lost at sea.

Another major object is to provide a means for providing such a person with a supply of rain water.

Further objects are to provide a backup supply of drinking water, a source of shade and a signaling means in the form of a mirror.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
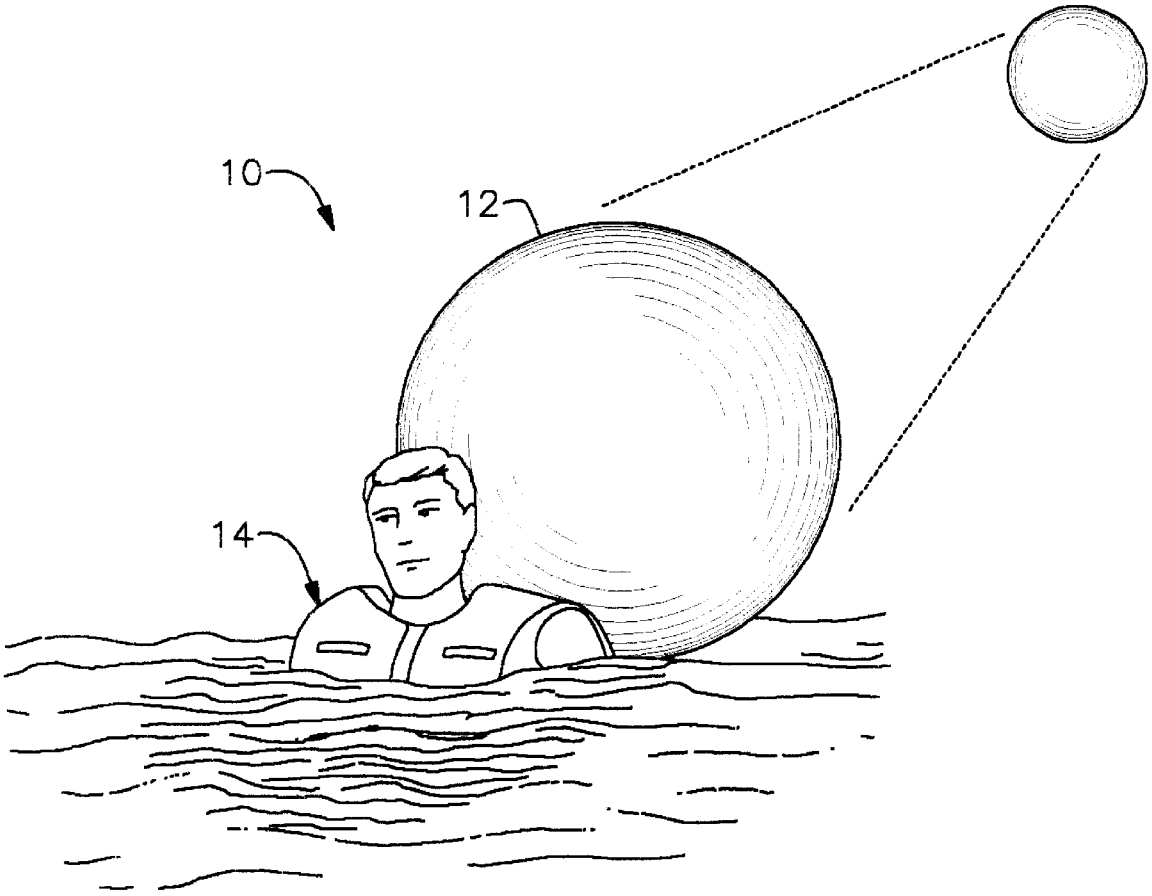
FIG. 1 is a perspective view depicting an illustrious embodiment of the invention in use.
Figure 2:
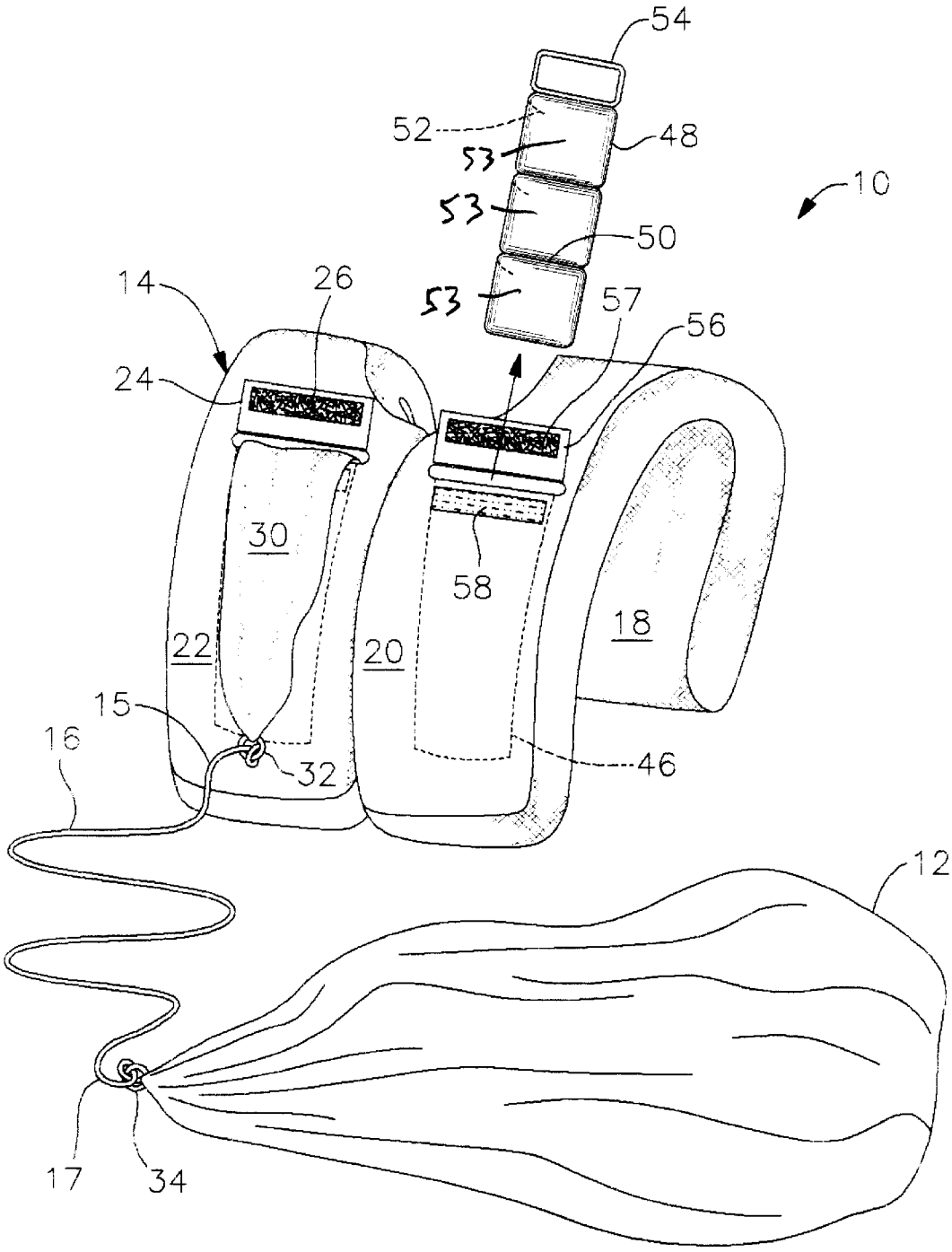
FIG. 2 is a perspective view depicting the balloon in a deployed but uninflated configuration and depicting the water packets when removed from their pocket.

Referring now to FIGS. 1 and 2, it will there be seen that an exemplary embodiment of the invention is denoted as a whole by the reference numeral 10.

Balloon 12 is tethered to life jacket 14 by an elongate tether cord 16 (FIG. 2) having a first end secured to a liner of a pocket formed within the life jacket and a second end secured to the balloon. The size and color of the balloon make it easy to find, even in a large body of water; accordingly, a commercial embodiment of the novel life jacket will be sold under the trademark EASYSPOT™ life jacket. Moreover, as indicated by FIG. 1, the size of the balloon enables it to provide a shade sufficient in size to allow a person awaiting rescue to avoid the debilitating effects of sunlight.

Life jacket 14 has a back part 18, a front left part 20 and a front right part 22. When worn, the respective inboard edges of left and right parts 20 and 22 confront one another and are held together by suitable fastening means in a well-known way.

Pocket flap 24 conceals the access opening of a pocket that is formed in a preselected part of the life jacket. In this particular embodiment, the pocket is formed in right part 22 of life jacket 14. Flap 24 may be held closed by a pair of hook and loop fastening strips, one strip 25 (FIG. 3) being secured to right part 22 of the life jacket just below the pocket opening and a second, complementary strip 26 being secured to the inside surface of pocket flap 24.

Figure 3:
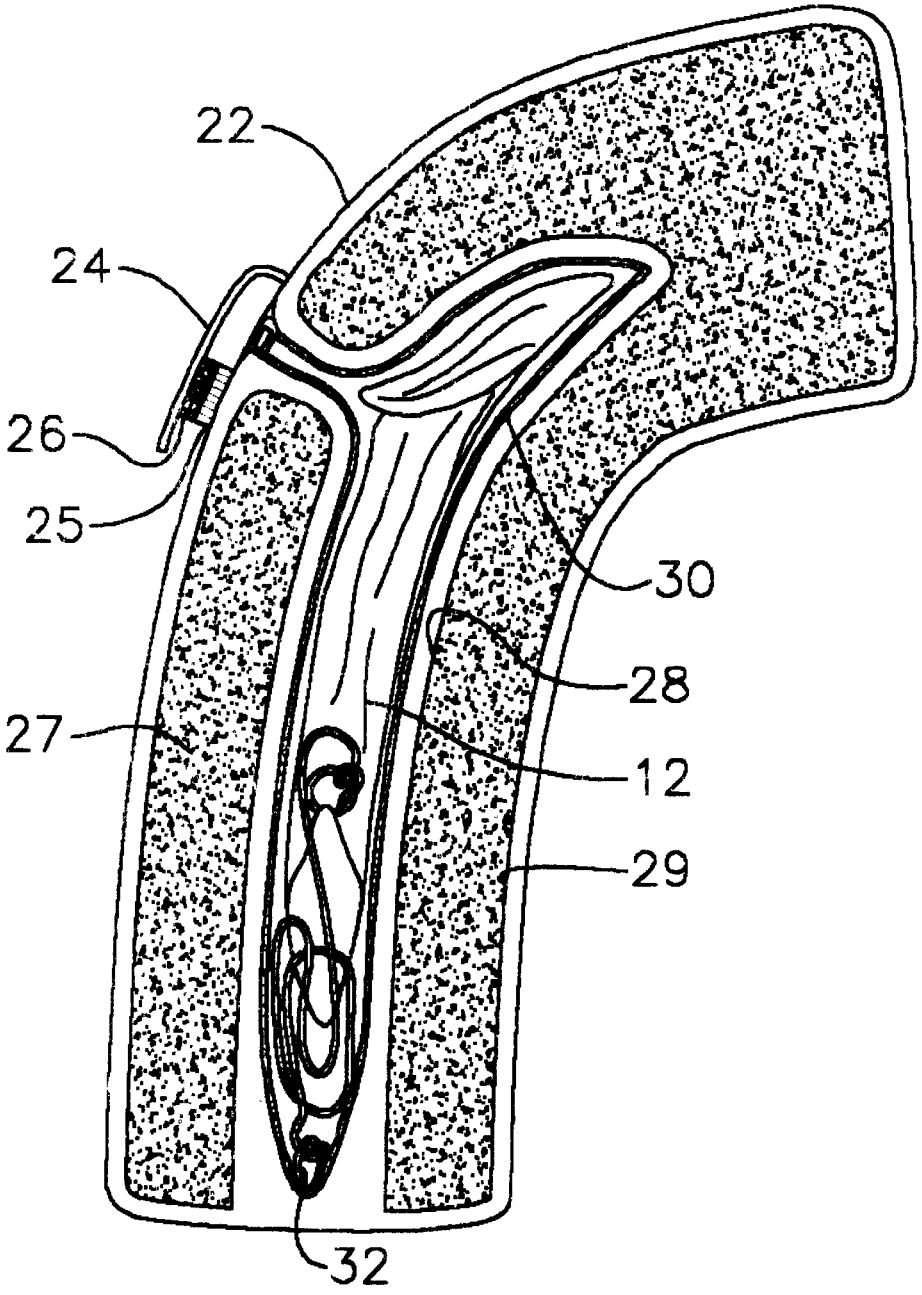
FIG. 3 is a sectional view of a life jacket equipped with the novel balloon.

As best depicted in FIG. 3, a hollow area or cavity 28 that is intermediate conventional flotation elements 27, 29 is lined with a bag-like liner 30 to form a pocket. The mouth of liner 30 circumscribes the access opening of the pocket and is secured thereto in a well-known way. Liner 30 is not otherwise secured to the life jacket so that said liner may be turned inside out. When turned inside out, liner 30 is external to life jacket right front part 22 as depicted in FIG. 2; this prevents water from entering into cavity 28 when pocket flap 24 is open and balloon 12 is deployed from cavity 28.

As best understood in connection with FIG. 2, mounting means 32 (FIGS. 2 and 3) is secured to the bottom of liner 30. Elongate, flexible tether cord 16 has a first end 15 secured to mounting means 32 and a second end 17 secured to a mounting means 34 that is secured to balloon 12. To deploy balloon 12, pocket flap 24 is opened and balloon 12 is manually removed from cavity 28 by pulling on the balloon until liner 30 has been turned inside-out. This prevents seawater from entering into cavity 28 as mentioned earlier.

Note from FIG. 3 that the external appearance of life jacket 14 is unaffected by the presence of deflated balloon 12 in the pocket defined by liner 30, i.e., there are no bulges in life jacket 14. Thus, the novel life jacket takes up no more storage space than a conventional life jacket, and it has a conventional appearance. Only the presence of flap 24 indicates to an observer that life jacket 14 is not an ordinary life jacket.

Balloon 12 is spread out over a large area within cavity 28 when in its deflated condition to distribute its weight. This makes it less noticeable to the wearer of the life jacket.

Figure 4:
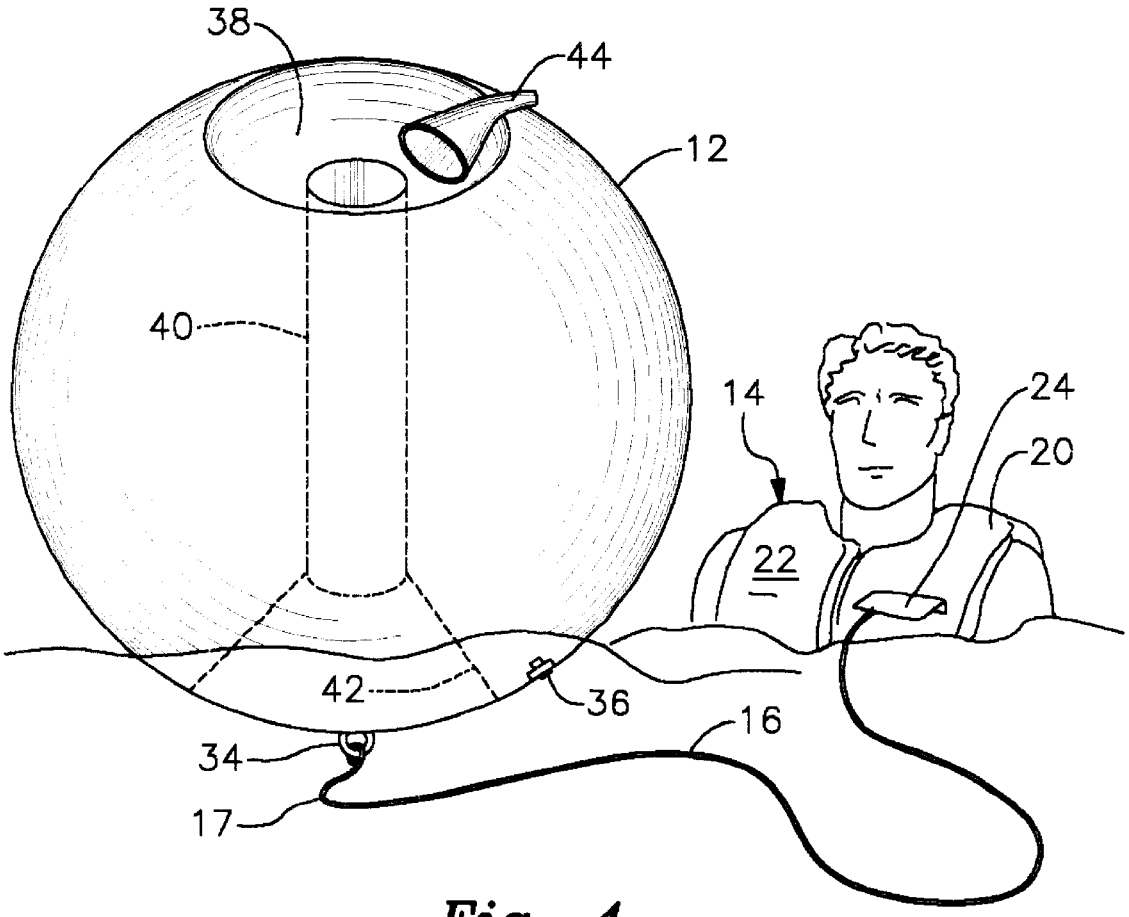
FIG. 4 is a perspective view depicting the interior structure of the balloon when in its inflated configuration.

Balloon 12 is manually inflated by blowing into inflation means 36 (FIG. 4), but this invention also contemplates use of a gas cylinder inflation means, not shown, to accomplish a faster inflation. When fully inflated, balloon 12 has a substantially spherical shape. The diameter of balloon 12 is about three feet and it has a bright orange color to enhance its visibility. FIG. 4 depicts pocket flap 24 as being on left front part 20 of life jacket 14, just to indicate that the novel structure may be provided on either side of life jacket 14.

The structure of balloon 12 includes a funnel 38 (FIG. 4) formed therein for collecting rainwater from an environment external to the balloon. Funnel 38 is formed in an external surface of balloon 12 and is in open communication with said external environment. Downspout 40 of funnel 38 depends from a narrow end of said funnel and is in fluid communication with a reservoir 42 that is positioned at the bottom of balloon 12 in diametrically opposed relation to funnel 38. Funnel 38 has a wide diameter to optimize collection of rainwater for storage in reservoir 42. Moreover, the location of reservoir 42 makes balloon 12 bottom heavy when rainwater has been collected in said reservoir, i.e., said bottom heavy feature inhibits the balloon from rocking over in response to wave action and thus protects the rainwater in reservoir 42 from spillage. Mounting means 34 is positioned in diametrically opposing relation to funnel 38 so that if reservoir 42 is empty, the weight of mounting means 34 is sufficient to maintain the balloon in its FIG. 4 position.

The walls of funnel 38, downspout 40 and reservoir 42 are made of the same or lighter material as the material of balloon 12.

Figure 5:
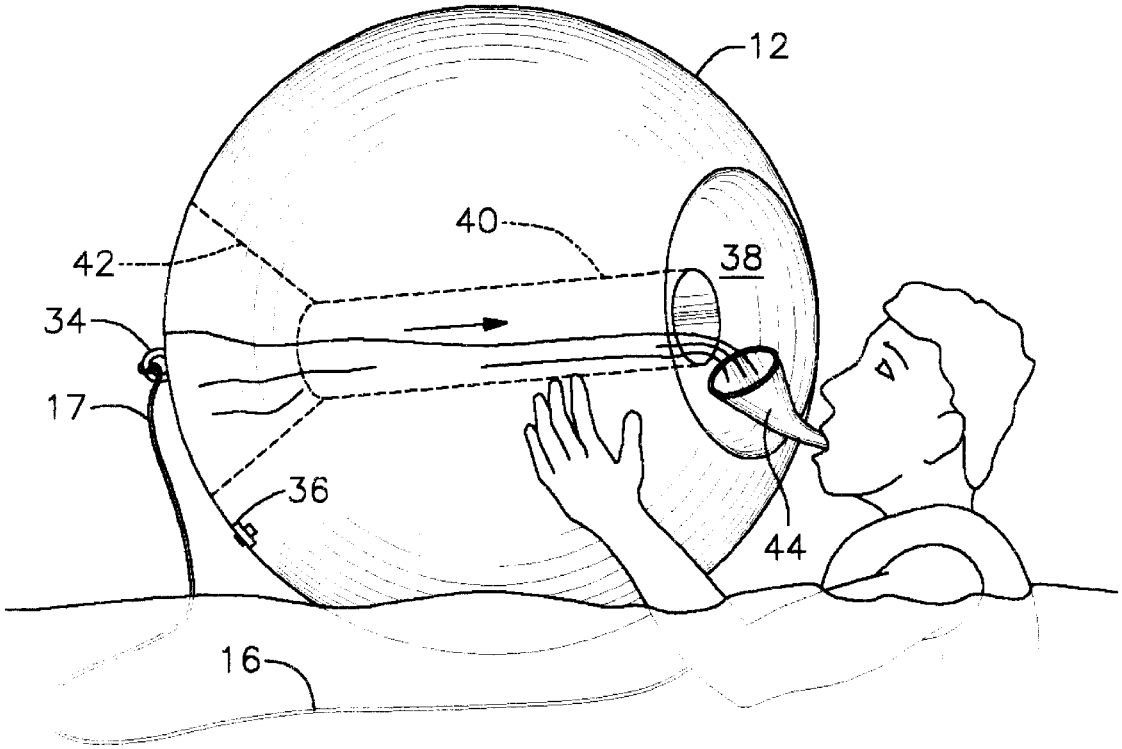
FIG. 5 is a perspective view similar to FIG. 4, but depicting the balloon when in its drinking water-dispensing mode.

A drinking spout 44 is positioned at a preselected location on the perimeter of funnel 38. Thus, to drink rainwater from reservoir 42, the person awaiting rescue tilts balloon 12 over in the manner depicted in FIG. 5.

Returning now to FIG. 2, left part 20 of life jacket 14 may include an internal cavity 46 for holding a plurality of pre-filled drinking water containers or bladders, collectively denoted 48, for use if there is insufficient rainfall. Each container 48 is separable from its contiguous container by tearing along perforations 50 so that the contents of the respective containers may be imbibed individually. Another perforation 52 is formed near the top of each container to facilitate drinking therefrom. Tab 54 surmounts the bladders to provide a handle means to facilitate removal of the bladders from cavity 46 when pocket flap 56 is opened. Like pocket flap 24, pocket flap 56 is secured when closed by complemetary hook and loop fastening members 57, 58.

A mirrored surface 53 is provided on one or more of the containers or on both sides of each container, for use in signaling.

In the claims that follow, cavity 28 that holds balloon 12 when undeployed and cavity 46 that holds water containers 48 are referred to as the first and second cavities, respectively. The parts related to the respective cavities, such as the respective pocket flaps 26 and 56, and the respective access openings covered by said pocket flaps, are referred to as the first and second pocket flaps and the first and second access openings.

Figure 6B:
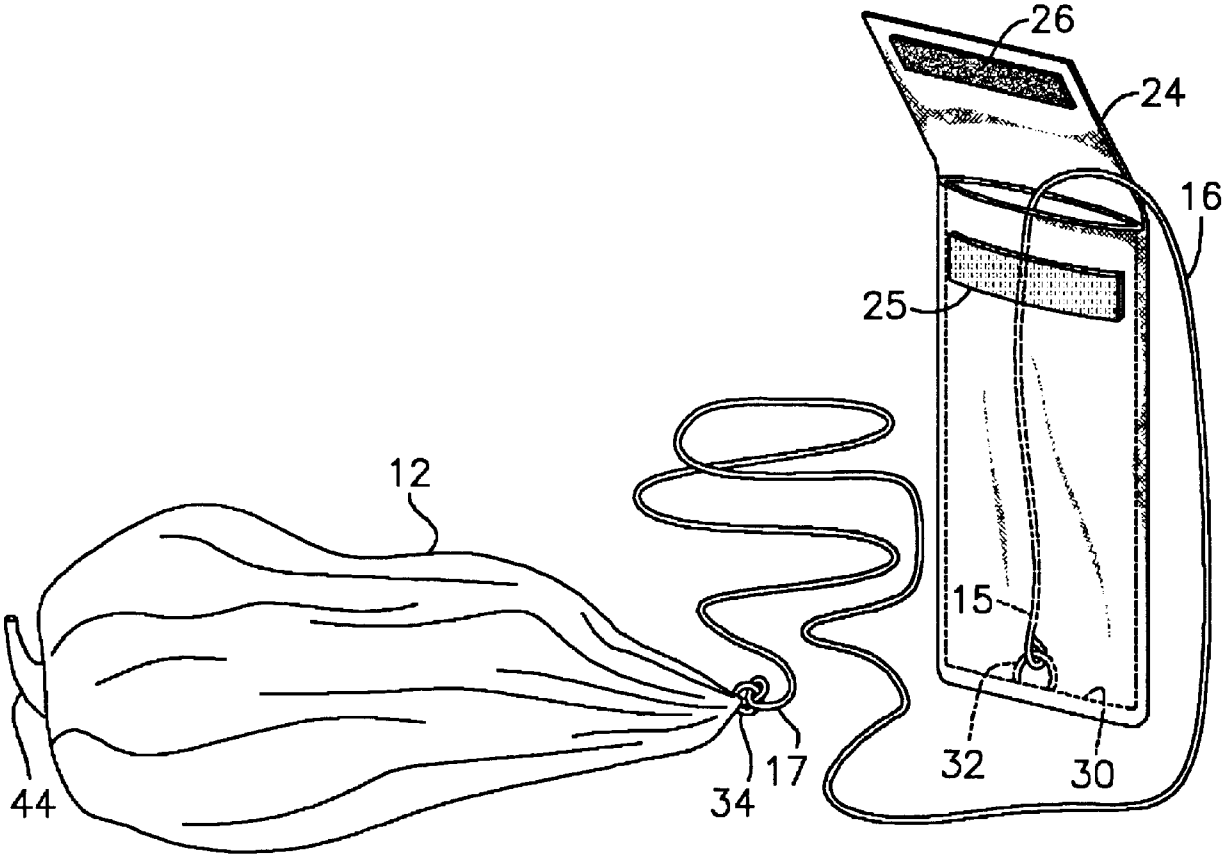
FIG. 6B is a perspective view depicting the retrofit pocket of FIG. 6A when the balloon is in its deployed but uninflated configuration.
Figure 6A:
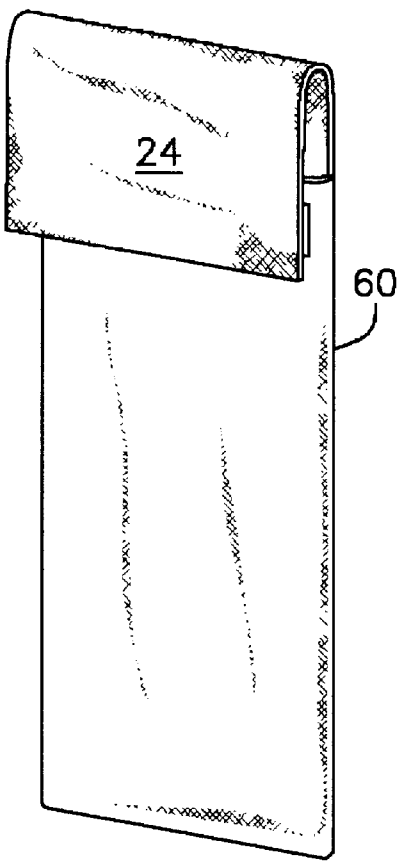
FIG. 6A is a perspective view of a pocket suitable for retrofitting to a conventional life jacket.

In an alternative embodiment of the invention, depicted in FIGS. 6A and 6B, a retrofit pocket 60 containing a deflated balloon is secured, by sewing or other suitable means, to the left or right front part of a conventional life jacket. The retrofit pocket includes the same access opening, pocket flap 24, liner 30, mounting means 34 and tether cord 16 as the first-described embodiment.

A second retrofit pocket having the same external appearance as pocket 60 could be secured to the left or right part of the life jacket as well. It would hold plural water containers 48 having mirrored surfaces or a separate mirror means. By attaching such retrofit pockets thereto, a conventional life jacket is easily converted into the novel life jacket. The novel pocket may also be retrofit to a life raft or other buoyant device as well.

Although the invention has been shown and described in connection with a life jacket having internal buoyant members, the invention may also be used with inflatable life jackets as well and therefore is not limited to the type of life jacket appearing in the drawings.

This invention represents a major advance in the life jacket art. It provides the first life jacket having a deployable, spherical balloon that floats on the water to facilitate search and rescue efforts. It further provides the first balloon having rainwater-collection means for use by a person awaiting rescue, and back-up water containers for use if natural rainfall fails to provide fresh water.

It will thus be seen that the objects set forth above, and those made apparent from the foregoing description, are efficiently attained. Since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described

What is claimed is:

1. A life jacket having a back part, a left front part and a right front part, said back, left front and right front parts being integrally formed with one another and said left and right front parts having inboard edges that are disposed in confronting relation to one another, comprising:

a first cavity formed within said life jacket;

a first access opening formed in a first preselected part of said life jacket to provide access to said first cavity;

a pocket means positioned within said first cavity;

said pocket means formed by a liner;

said liner having a mouth that circumscribes and is secured to said first access opening;

a deflated balloon disposed within said pocket;

a mounting means secured to said liner;

an elongate tether line having a first end secured to said mounting means;

said elongate tether line having a second end secured to said deflated balloon; and said balloon adapted to be inflated when said balloon is disposed external to said pocket;

whereby removing said balloon and said tether line from said pocket reverses said liner by pulling said liner inside-out and thereby prevents entry of water into said first cavity.

2. The life jacket of claim 1, further comprising a first pocket flap secured to said first preselected part of said life jacket in covering relation to said first access opening to prevent water from entering into said pocket means when said balloon and said tether line are disposed within said pocket means.

3. The life jacket of claim 1, further comprising an inflation means for inflating said balloon when it is positioned externally to said pocket means.

4. The life jacket of claim 1, further comprising;

a funnel formed in said balloon;

said funnel being formed in a surface of said balloon and in open communication to an environment external to said balloon;

a downspout formed integrally with a lowermost end of said funnel;

a reservoir integrally formed with a lowermost end of said downspout in diametrically opposed relation to said funnel;

whereby rainwater caught by said funnel is retained within said reservoir.

5. The life jacket of claim 4, further comprising:

a drinking spout secured to said balloon at a preselected point along a perimeter of said funnel;

whereby tilting said balloon enables rainwater in said reservoir to flow from said reservoir, through said downspout, over said funnel and into said drinking spout.

6. The life jacket of claim 1, further comprising:

a second cavity formed within said life jacket;

a second access opening formed in a second preselected part of said life jacket;

a water container means positioned within said second cavity;

whereby water in said water container means may be consumed by a user of said life jacket.

7. The life jacket of claim 6, further comprising a second pocket flap secured to said second preselected part of said life jacket to prevent water from an environment external to the life jacket from entering into said second access opening.

8. The life jacket of claim 6, wherein said water container means is a plurality of water bladders that are releasably connected to one another to enable them to be separated from one another and their respective contents consumed independently of one another.

9. The life jacket of claim 8, further comprising means for opening each of said water bladders to facilitate consumption of water therefrom.

10. The life jacket of claim 9, wherein at least one of said water bladders includes a mirrored surface for use as a signaling device.

11. A balloon, comprising:

means for inflating said balloon into a spherical shape;

a funnel formed in said balloon, said funnel having an opening in open communication with an environment external to said balloon;

a downspout formed in said balloon, said downspout depending from a narrow end of said funnel;

a reservoir positioned in open fluid communication with said downspout so that rainwater collected by said funnel is retained within said reservoir;

means for tethering said balloon to a life jacket; and drinking spout means connected to said balloon in fluid communication with said reservoir so that a person awaiting rescue while floating in a body of water may consume rainwater from said reservoir.

12. The balloon of claim 11, wherein said means for tethering said balloon to said life jacket includes a mounting means mounted on said balloon at a preselected location that is diametrically opposed to said opening of said funnel so that when said balloon is inflated and floating in a body of water, said funnel is positioned at a top of said balloon and said mounting means is positioned at a bottom thereof so that the balloon is in an upright position to catch rainwater.

13. A pocket means adapted to be retrofit to a life jacket or a life raft, comprising:

a pocket member;

said pocket member having an access opening;

a pocket flap for selectively closing said access opening;

a liner disposed within said pocket member, said liner having a mouth part thereof secured to said access opening of said pocket member and said liner defining a cavity;

a deflated balloon disposed within said cavity;

a mounting member secured to a preselected part of said liner;

an elongate, flexible tether having a first end secured to said mounting member and a second end secured to said balloon; and means for attaching said pocket to an external surface of said life jacket;

whereby said balloon may be deployed from said pocket and inflated to facilitate visual sighting of a person wearing said life jacket; and whereby said liner is turned inside-out when said balloon is deployed so that water cannot enter into said cavity.

14. A pocket means adapted to be retrofit to a life jacket or a life raft, comprising:

a pocket member;

said pocket member having an access opening;

a pocket flap for selectively closing said access opening;

a cavity defined within said pocket member;

at least one water container disposed within said cavity;

means for attaching said pocket member to an external surface of said life jacket;

said at least one water container containing a plurality of water containers that are releasably secured to one another so that their respective contents may be imbibed independently of one another.

15. The pocket of claim 14, wherein at least one water container of said plurality of water containers includes a mirrored surface for use as a signaling device.

* * * * *